US006091921A

United States Patent [19]

Sato et al.

[11] Patent Number: 6,091,921

[45] Date of Patent: Jul. 18, 2000

[54] DEVELOPING DEVICE INCLUDING DEVELOPER LEVELING MEMBER

[75] Inventors: Kunihiko Sato; Takefumi Takahashi; Sachio Sasaki; Nobuo Kuwabara, all of Kawasaki, Japan

[73] Assignee: Fujitsu Limited, Kawasaki, Japan

[21] Appl. No.: 09/291,209

[22] Filed: Apr. 14, 1999

[30] Foreign Application Priority Data

Apr. 16, 1998 [JP] Japan ..... 10-106336

[51] Int. Cl.[7] ..... G03G 15/09

[52] U.S. Cl. ..... 399/274; 399/267

[58] Field of Search ..... 399/119, 222, 399/265, 267, 272, 274, 284

[56] References Cited

U.S. PATENT DOCUMENTS

| | | | |
|---|---|---|---|
| 4,786,936 | 11/1988 | Ikegawa et al. | 399/272 |
| 4,838,200 | 6/1989 | Hosoi et al. | 399/274 X |
| 4,966,356 | 10/1990 | Ohyabu et al. . | |
| 4,996,567 | 2/1991 | Watarai et al. . | |
| 5,188,057 | 2/1993 | Ishikawa et al. . | |
| 5,659,860 | 8/1997 | Sasaki et al. | 399/267 |
| 5,758,241 | 5/1998 | Oyama et al. | 399/272 |
| 5,790,929 | 8/1998 | Goto et al. | 399/260 |

FOREIGN PATENT DOCUMENTS

| | | |
|---|---|---|
| 0 575 159 A2 | 12/1993 | European Pat. Off. . |
| 1-98529 | 4/1989 | Japan . |
| 1-289988 | 11/1989 | Japan . |
| 3-174175 | 7/1991 | Japan . |
| 5-346751 | 12/1993 | Japan . |

*Primary Examiner*—Sandra Brase

*Attorney, Agent, or Firm*—Armstrong, Westerman, Hattori, McLeland & Naughton

[57] ABSTRACT

A developing device develops a latent image formed on a latent image holding body. The developing device includes a developing roller conveying, with rotation of the developing roller, developer adhered thereto to a developing area in which the latent image on the latent image holding body should be developed, the developer including toner and carriers, a limit member, provided so as to face the developing roller, limiting a height of a layer of the developer on the developing roller, a toner container storing the toner, a toner supply mechanism supplying the toner in the toner container to the developing roller, and a partition member forming a space between the partition member and the developing roller, the toner supplied from the toner container being moved in the space with rotation of the developing roller. The developing device further includes a developer leveling member provided on an upstream side of the space in a rotation direction of the developing roller, the developer leveling member leveling the developer, formed on the developing roller, which developer has passed through the developing area.

10 Claims, 9 Drawing Sheets

DEVELOPING DEVICE INCLUDING DEVELOPER LEVELING MEMBER

BACKGROUND OF THE INVENTION

1. Field of the Invention

The present invention relates to a developing device used in an image forming apparatus such as an electrophotographic printer, and more particularly relates to a developing device which develops latent images on a surface of a latent image holding body.

2. Description of the Related Art

In an electrophotographic printer, such as a laser printer, a surface of a latent image holding body, such as a photosensitive drum, is exposed by light from an exposing unit including an optical system so that a latent image (an electrostatic latent image) is formed. The latent image formed on the surface of the latent image holding body is developed. An image obtained by the development is transferred to a paper, so that a print is made on the paper.

In a developing device used in such a printer, developer (e.g., toner) is conveyed by a developing roller and supplied to the latent image holding body. The latent image formed on the latent image holding body is then developed by the developer and a visual image is formed.

There are two developing methods; a dual-component developing method and a mono-component developing method. In the dual-component developing method, dual-component developer made of toner and carriers is used. In the mono-component developing method, only toner is used as the developer.

According to the dual-component developing method, a large amount of toner can be conveyed. The dual-component developing method is thus suitable for a printer for which a high-speed print operation is required.

According to the mono-component developing method, although a small amount of toner can be conveyed, a structure of a printing process unit can be miniaturized. The mono-component developing method is suitable for a miniaturized printer.

Further, a method for improving the printing speed in a miniaturized printer is proposed in Japanese Laid Open Patent Application No. 3-174175. In such a method, the carriers exist only surrounding the developing roller and toner is supplied to the latent image holding body via the carriers for the development. The toner is supplied from a toner container behind the developing roller to the carriers surrounding the developing roller.

Although the printer for which the high-speed printing operation is required can be miniaturized by using the conventional developing device operating in accordance with the method as described above, it may be required for the conventional developing device to improve the quality and definition of images.

SUMMARY OF THE INVENTION

Accordingly, a general object of the present invention is to provide a novel and useful developing device in which the disadvantages of the aforementioned prior art are eliminated.

A specific object of the present invention is to provide a developing device by which the quality and definition of images, formed by a miniaturized image forming apparatus for which the high speed printing operation is required, can be improved.

The above objects of the present invention are achieved by a developing device developing a latent image formed on a latent image holding body, comprising: a developing roller which is rotatably supported, conveying, with rotation of the developing roller, developer adhered thereto to a developing area in which the latent image on the latent image holding body should be developed, the developer including toner and carriers; a limit member, provided so as to face the developing roller, limiting a height of a layer of the developer on the developing roller; a toner container storing the toner; a toner supply mechanism supplying the toner in the toner container to the developing roller; a partition member forming a space between the partition member and the developing roller, the toner supplied from the toner container being moved in the space with rotation of the developing roller; and a developer leveling member provided on an upstream side of the space in a rotation direction of the developing roller, the developer leveling member leveling the developer, formed on the developing roller, which passed through the developing area.

According to the present invention, the developer leveling member uniformly levels the developer on the developing roller which developer has passed through the developing area. Thus, the toner can be stably supplied from the developer on the developing roller to the latent image holding body.

BRIEF DESCRIPTION OF THE DRAWINGS

Other objects, features and advantages of the present invention will be apparent from the following description when read in conjunction with the accompanying drawings, in which.

DESCRIPTION OF THE PREFERRED EMBODIMENTS

A description will now be given, with reference to the drawings, of embodiments of the present invention.

Figure 1:
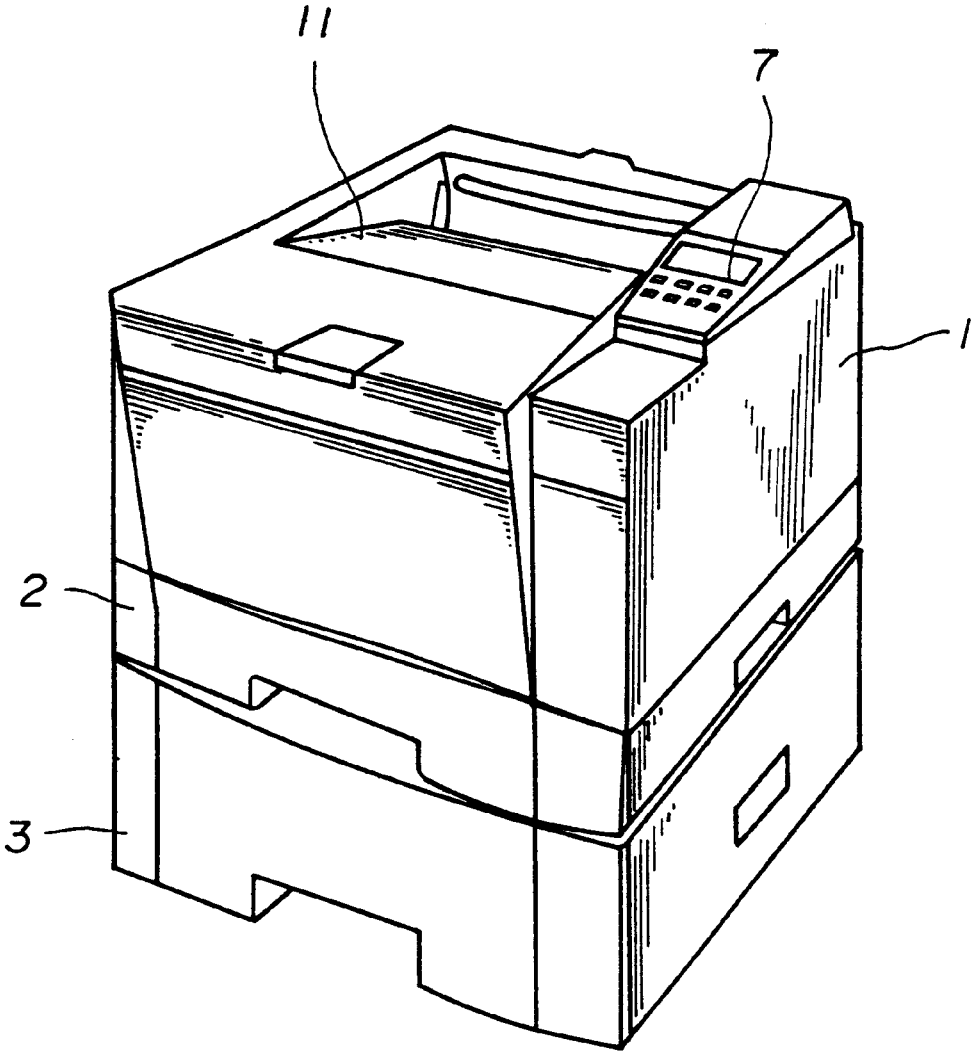
FIG. 1 is a perspective view showing a printer in which a developing device according to an embodiment of the present invention is provided.

An exterior of a printer to which a developing device according to an embodiment of the present invention is applied is formed as shown in FIG. 1. Referring to FIG. 1, the printer which is one type of an image forming apparatus has various units used to form images in the inside thereof. The printer has a printer body 1 and paper supply units (a dual print unit 2 and a first paper supply unit 3). A stacker 11 on which printed papers are stacked is formed on an upper portion of the printer body 1. The paper supply units are provided at a user's option. In this case, the dual print unit 2 and the first paper supply unit 3 are optionally set on the printer body 1 as the paper supply units. The dual print unit 2 turns a recording paper in which an image is formed on a first side and supplies the turned paper to the printer body 1 to print on a second side of the recording paper. Recording papers are stacked in the first paper supply unit 3. Recording papers are successively supplied to the printer body 1 from the first paper supply unit 3. Another paper supply unit may be additionally set under the first paper supply unit 3. If recording papers having different sizes and used for different purposes are set in a plurality of paper supply units, prints can be made in accordance with various print requests from the user without changing recording papers in a single paper supply unit.

Figure 2:
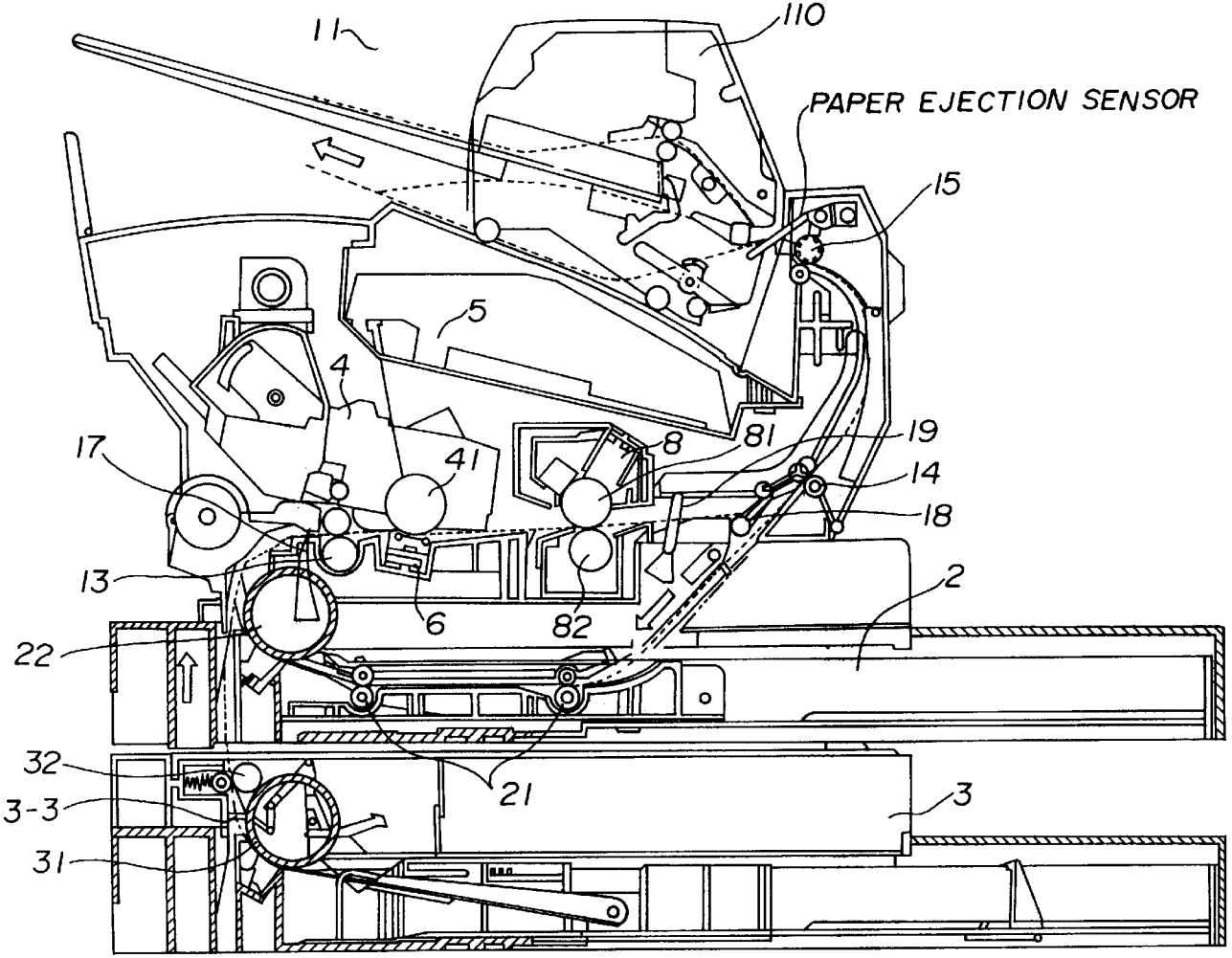
FIG. 2 is a diagram illustrating an inner structure of the printer shown in FIG. 1.

The inner structure of the printer is formed as shown in FIG. 2.

Referring to FIG. 2, in order to print on recording papers, the recording papers stacked in the first paper supply unit 3 are picked up and fed by a pickup roller 31 one by one. The picked-up recording paper is fed upward by a feed roller 32. A feed timing of the recording paper is adjusted and the recording paper is further fed to a transfer stage by a registration roller 13. A toner image formed on a photosensitive drum 41 by a printing unit 4 is transferred to the recording paper in the transfer stage. The recording paper to which the toner image is transferred is supplied to a fixing unit 8. The toner image is then fixed on the recording paper by heat and pressure from the fixing unit 8. The recording paper on which the image is fixed is fed by first and second ejecting rollers 14 and 15 and ejected to the stacker 11.

A printing process is executed in accordance with a known procedure as described in Japanese Laid Open Patent Application No. 1-98529 so that a print is made.

The printer is connected to a host, such as a personal computer or a server, via a printer cable or a LAN. A controller which receives a print request from the host expands print data received together with the print request and supplies the print data to a mechanism controller as video data. The mechanism controller controls mechanical portions based on the video data.

The printer may be in an on-line state or an off-line state by operations on an operation panel 7 by a user.

A paper size sensor detects the size of the recording papers stored in the first paper supply unit 3. The mechanism controller determines, based on a detecting signal from the paper size sensor, whether the size of the recording paper specified by the print request is equal to the size of the recording papers stored in the first paper supply unit 3. If the sizes of the recording papers are equal to each other, the mechanism controller drives a paper supply motor.

When the paper supply motor is driven, a pickup-and-feeding operation starts so that the pickup roller 31 and the registration roller 13 are rotated in a direction in which the recording papers are fed. Due to the rotations of the pickup roller 31 and the registration roller 13, a recording paper is picked up from the stored recording papers in the first paper supply unit 3 and fed upward. It is determined, based on a detecting result of a paper supply sensor 3—3, whether a recording paper has been picked up and fed from the first paper supply unit 3. That is, if the paper supply sensor 3—3 does not detect a recording paper although the pickup roller 31 has rotated by a predetermined amount of rotation, it is determined that the recording paper has not been picked up and fed in an error-free state. The pickup-and-feeding operation for the recording paper is thus discontinued. After this, the pickup-and-feeding operation is restarted. On the other hand, if the paper supply sensor 3—3 detects a recording paper before the pick-up roller 31 has rotated by the predetermined amount of rotation, it is determined that the recording paper has been picked up and fed in the error-free state. The pickup-and-feeding operation is continued.

From a time at which a registration sensor 17 detects a leading edge of the recording paper fed by the pickup roller 31 and the feed roller 32, the recording paper is further fed until the leading edge of the recording paper runs into the registration roller 13. The distance between a position at which the registration sensor 17 detects the leading edge of the recording paper and the registration roller 13 is previously stored in a memory. The paper supply motor is stopped when the recording paper has been fed by the distance stored in the memory from the time at which the registration sensor 17 detects the leading edge of the recording paper.

Immediately after the paper supply motor is stopped, a feed motor is started so that the recording paper is fed by the registration roller 13.

The printing unit 4 has the photosensitive drum, a developing device, a cleaner unit and a charging unit, all of which are used to form a toner image to be transferred to the recording paper.

A transfer unit 6 located at the transfer stage transfers a toner image formed on the photosensitive drum 41 to the recording paper. When the recording paper reaches the transfer stage, a power supply of the transfer unit 6 is turned on so that the transfer unit 6 becomes in an active state. The transfer unit 6 faces the printing unit 4 via a feeding path in which the recording paper passes. The transfer unit 6 has a known structure using a discharging wire. When the recording paper is at the transfer stage, the discharging wire to which a voltage is applied discharges. Due to the discharge, the toner image on the photosensitive drum 41 is attracted and adhered to a print surface of the recording paper.

The transfer unit 6 may have another structure using a roller, made of a conductive rubber, to which a voltage is applied as disclosed in Japanese Laid Open Patent Application No. 5-346751. The recording paper is put between the roller and the photosensitive drum so that the roller presses the recording paper against the photosensitive drum. In this state, the toner image is transferred from the photosensitive drum to the recording paper (a roller transferring method).

The recording paper to which the toner image is transferred by the transfer unit 6 is fed to the fixing unit 8 by the registration roller 13.

The fixing unit 8 may have a known structure as described in Japanese Laid Open Patent Application No. 1-289988.

The fixing unit 8 includes a heat roller 81 and a pressure roller 82. The heat roller 81 is provided with a heat source in the inside thereof and rotated by a motor (not shown). A rotation shaft of the pressure roller 82 is supported by elastic members, such as coil springs, so that the pressure roller 82 is pressed against the heat roller 81 at a predetermined pressure. The pressure roller 82 is a driven roller rotated in accordance with the rotation of the heat roller 81.

In addition, the surface of the pressure roller 82 is heated by the heat roller 81 so that the surface temperature of the pressure roller 82 is close to that of the heater roller 81. Thus, both surfaces of the recording paper are heated so that the fixing efficiency is improved. The heat roller 81 is in contact with a print surface of the recording paper. A width of each of the heat roller 81 and the pressure roller 82 is set at a value larger than a width of a recording paper having the maximum size usable in the printer. For example, in a case where the maximum size is A3, the width of each of the heat roller 81 and pressure roller 82 is larger than 297 millimeters. Due to the heat and pressure, the toner on the recording paper put between the heat roller 81 and pressure roller 82 is softened and the toner image is fixed.

The recording paper on which the toner image is fixed by the fixing unit 8 is further fed to the stacker by the first and second ejecting rollers 14 and 15, in a case of a single surface print.

In a case of the dual print, the recording paper in which the print has been made on the first surface in accordance with the single surface print process as described above is fed by the first and second ejecting rollers 14 and 15 until the tail end of the recording paper passes through a gate 18.

The gate 18 is closed, in a normal state, in the feed path between the fixing unit 8 and the stacker 11 by a spring. The recording paper which travels in the feed path pushes and opens the gate 18. The recording paper then passes through the gate 18. When the tail end of the recording paper passes through the gate 18, the gate 18 is restored so as to be closed in the feed path between the fixing unit 8 and the stacker 11. When a predetermined time has elapsed from a time at which the tail end of the recording paper is detected by a passing sensor 19, it can be determined that the tail end of the recording paper has passed through the gate 18. The predetermined time is decided based on time periods measured in an experiment on feeding the recording paper. When the tail end of the recording paper passes through the gate 18, the first and second paper feed rollers 14 and 15 are reversed. The recording paper is thus returned in an opposite direction.

The recording paper returned in the opposite direction is fed to the dual print unit 2 via the gate 18. The recording paper is further fed to the registration roller 13 by dual print feed rollers 21 and a dual print pickup roller 22.

The recording paper supplied from the dual print unit 2 is fed to the transfer stage again by the registration roller 13. In the printing unit 4, the print is made on the second surface of the recording paper in the same manner as in the case of the first surface. The recording paper in which the print has been made on the second surface thereof is fed to the fixing unit 8. After the toner image formed on the second surface is fixed by the fixing unit 8, the recording paper is ejected to the stacker 11 by the ejecting rollers 14 and 15.

Figure 3:
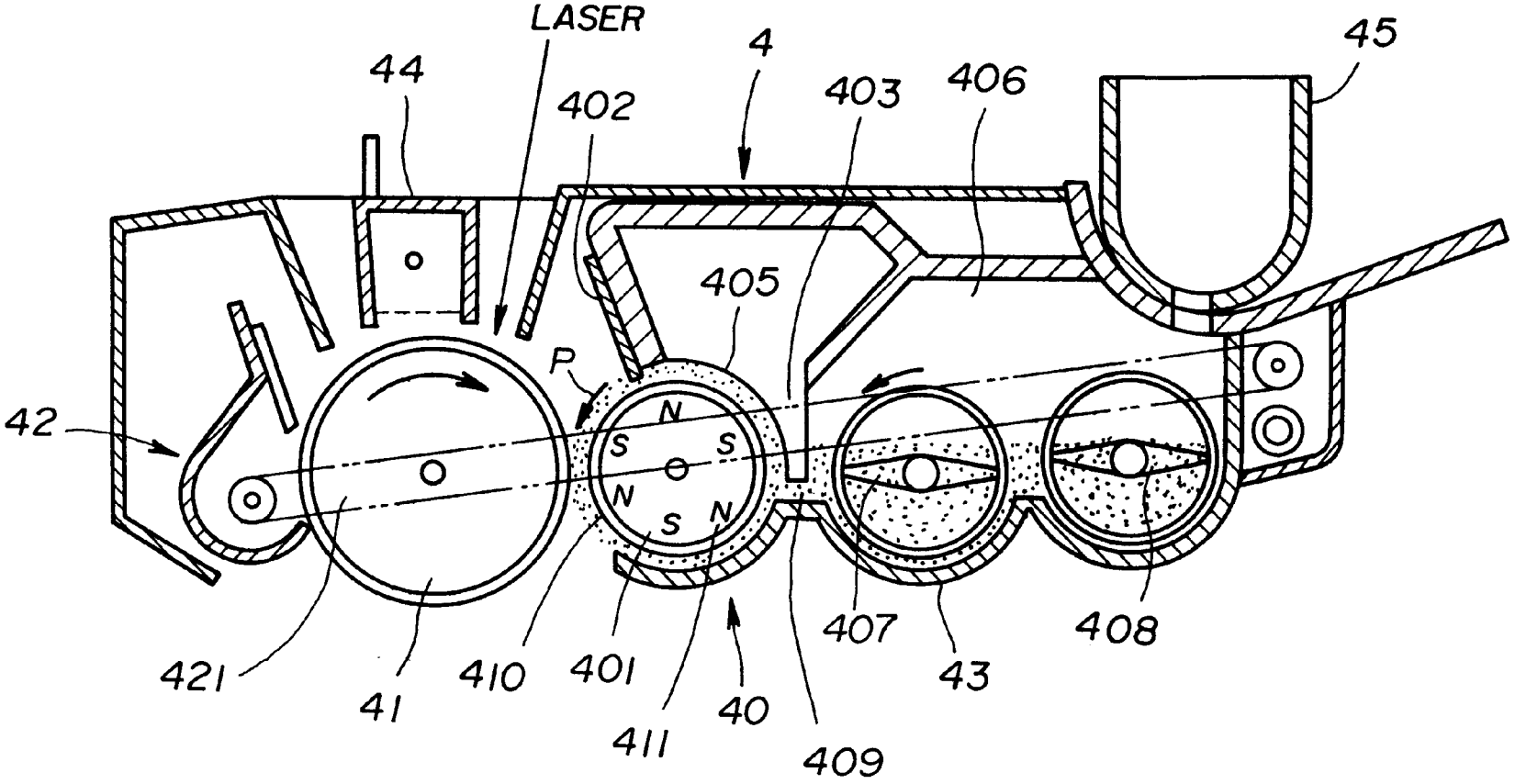
FIG. 3 is a cross sectional view showing a print process unit used in the printer.

The printing unit 4 is formed as shown in FIG. 3. In the printing unit 4 shown in FIG. 3, the photosensitive drum 41 and the cleaner unit 42 are integrated. The developing device 40 is detachably attached to the assembly of the photosensitive drum 41 and the cleaner unit 42.

The printing unit 4 in which the developing device 40 is attached to the assembly of the photosensitive drum 41 and the cleaner unit 42 is detachably mounted in the printer. A corona charging unit 44 is set in a concave portion formed on an upper surface of a housing 43 of the printing unit 4. An aperture through which light emitted from an optical unit 5 passes to expose the photosensitive drum 41 is also formed on the upper surface of the housing 43.

The photosensitive drum 41 is formed of an aluminum drum and a photosensitive layer covering the aluminum drum. The photosensitive layer is made of function separation type organic photosensitive material and has a thickness of about 20 $\mu$m. The outer diameter of the photosensitive drum 41 is equal to 30 millimeters and rotated at a peripheral velocity of 70 mm/sec. The corona charging unit 44 which is a scorotron charger uniformly charges the surface of the photosensitive drum 41 at about −600 volts.

The light emitted from the optical unit 5 exposes the surface of the uniformly charged photosensitive drum 41 so that a latent image is formed. The latent image has potentials falling within a rage of −50~−100 volts. The latent image is developed by the developing device 40 having a developing roller 401, so that a toner image corresponding to the latent image is formed on the photosensitive drum 41.

The developing device 40 has the developing roller 401 which is rotated in a direction indicated by an arrow P in FIG. 3. The developing roller 401 has a fixed magnetic pole body 411 including a plurality of magnetic poles and a sleeve 410 rotated around the fixed magnetic pole body 411. Only the sleeve 410 is rotated in the direction P, so that the developer is conveyed to a developing area which faces the photosensitive drum 41. In order to stably supply the toner to the photosensitive drum 41, a doctor blade 402 which limits the thickness of a layer of developer adhered to the developing roller 401 is provided.

The doctor blade 402 controls the height of bristles of a magnetic brush formed of the carriers on the developing roller 401 to be a constant, so that the toner can be stably supplied to the photosensitive drum 41. The magnetic brush is in contact with the latent image formed on the photosensitive drum 41. The toner is then attracted to the photosensitive drum 41 by an electrostatic force, so that the latent image is developed.

A carrier container 405 is formed so as to be surrounded by the doctor blade 402 attached to the housing 43, a partition member 403 and the developing roller 401.

The carrier container 405 stores the developer made of carriers and toner. A toner container 406 stores only toner. First and second agitators 407 and 408 are provided in the toner container 406. The first and second agitators 407 and 408 are rotated so that toner is conveyed from the toner container 406 to the carrier container 405. While the first and second agitators 407 and 408 are being rotated, the toner is agitated in the toner container 406 and supplied to the carrier container 405 through a toner supply opening 409. Thus, the toner density in the carrier container 405 is maintained at a substantially constant value.

A toner cartridge 45 is detachably set on the developing device 40. The toner is supplied from the toner cartridge 45 to the toner container 406. When the amount of remaining toner in the toner container 406 is scarce, a user changes the toner cartridge 45.

The cleaner unit 42 is in contact with the photosensitive drum 41. The residual toner which was not transferred to the recording paper is scraped off the photosensitive drum 41, so that the photosensitive drum 41 is cleaned. The residual toner collected by the cleaner unit 42 is returned to the toner container 406 by a toner return mechanism 421 to effectively reuse the toner. The toner supplied from the toner cartridge 45 and the residual toner returned by the toner return mechanism 421 are uniformly agitated by the first and second agitators 407 and 408.

In FIG. 2, the recording paper is fed from the left side of the printing unit 4 to the right side thereof. In FIG. 3, the recording paper is fed from the right side of the printing unit 4 to the left side thereof.

In the developing device 40 as described above, the carriers surrounding the developing roller 401 are conveyed in accordance with the rotation of the sleeve 410. The toner in the carrier container 405 is attracted, by the electrostatic force, to the magnetic brush formed of the carriers on the developing roller 401. The toner attracted to the magnetic brush is conveyed together with the carriers. While the toner is being conveyed, the thickness of the developer layer is limited by the doctor blade 402. That is, the height of the bristles of the magnetic brush which is in contact with the photosensitive drum 41 is limited. However, while the carriers conveyed in accordance with the rotation of the sleeve 410 are being moved between magnetic poles of the fixed magnetic pole body 411, the bristles of the magnetic brush formed of the carriers may collapse. When the magnetic brush in which the bristles thereof collapse passes through a region close to the toner supply opening 409, the toner in the carrier container 405 is not uniformly attracted to the magnetic brush. The toner which is not uniformly attracted to the magnetic brush is not uniformly supplied to the photosensitive drum 41. Thus, the density of toner transferred to the photosensitive drum 41 is uneven. As a result, an image having a high quality and definition can not be obtained.

Figure 4:
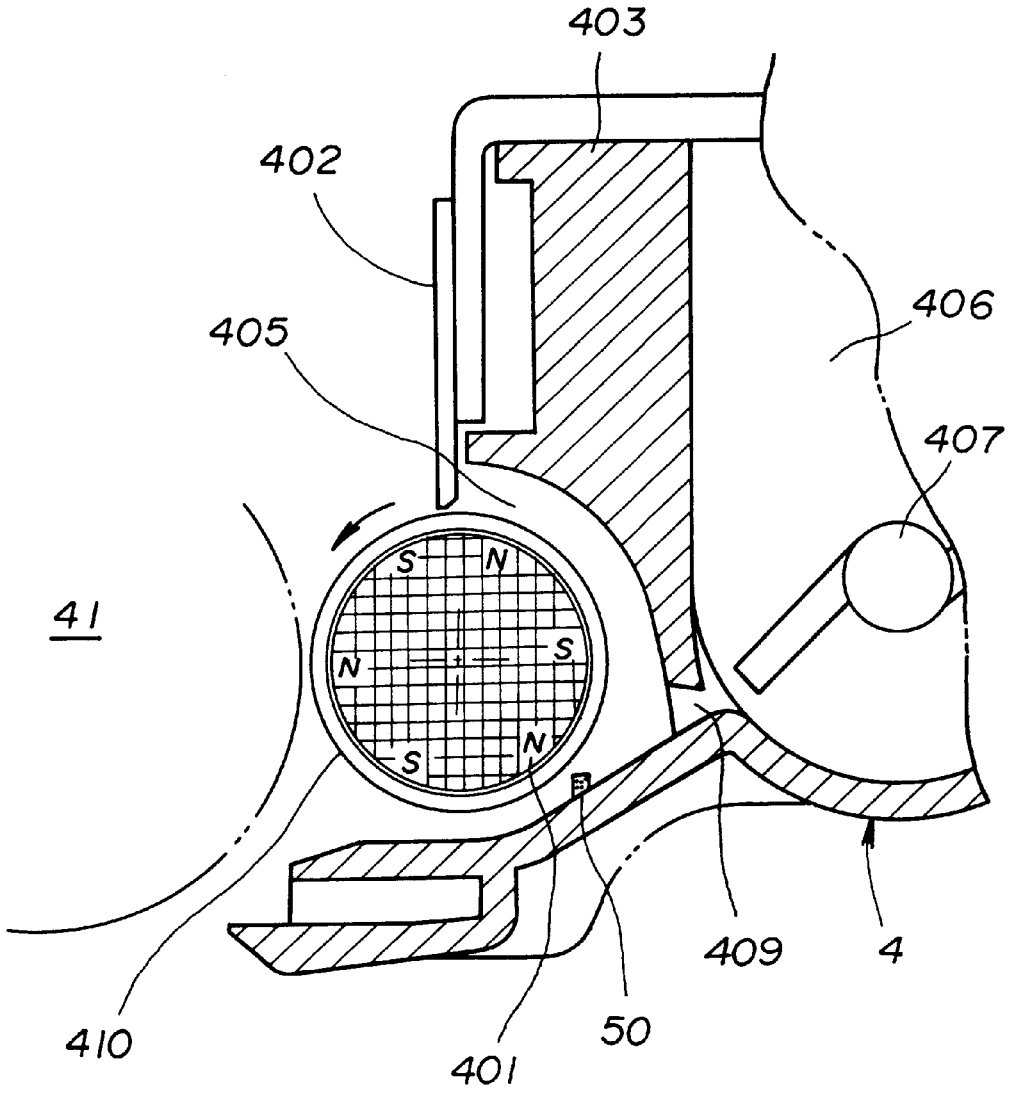
FIG. 4 is a cross sectional view showing a developing device provided in the print process unit.

Thus, a developer leveling member 50 is provided, as shown in FIG. 4, between the toner supply opening 409 and a developing region. The developer leveling member 50 faces a magnetic pole of the fixed magnetic pole body 411. The developer leveling member 50 has a rectangular cross section and extends in a width direction of the developing device 40.

In the printing operation, while the developing roller 401 is being rotated, the height of the developer layer is limited. A constant amount of developer is thus conveyed by the developing roller 401. In this state, the height of the bristles of the magnetic brush formed of carriers to which the toner is attracted is macroscopically constant. However, the carriers forming the magnetic brush are affected by variation of magnetic forces of the magnetic poles, the distribution of sizes of the carriers and movement over the magnetic poles. Thus, the respective bristles of the magnetic brush microscopically differ from each other.

The magnetic brush to which the toner is attracted is conveyed to the developing region by the developing roller 401. The latent image formed on the photosensitive drum 41 is then developed in the developing region. After the development, the magnetic brush is further conveyed by the developing roller 401. The magnetic brush is brought into contact with the developer leveling member 50. While the magnetic brush is passing the space between the developing roller 401 and the end of the developer leveling member 50, the bristles of the magnetic brush are leveled. The magnetic brush in which the bristles thereof are leveled passes through the carrier container 405. The toner in the carrier container 405 is thus uniformly attracted to the magnetic brush having the leveled bristles and conveyed to the developing region.

Figure 5:
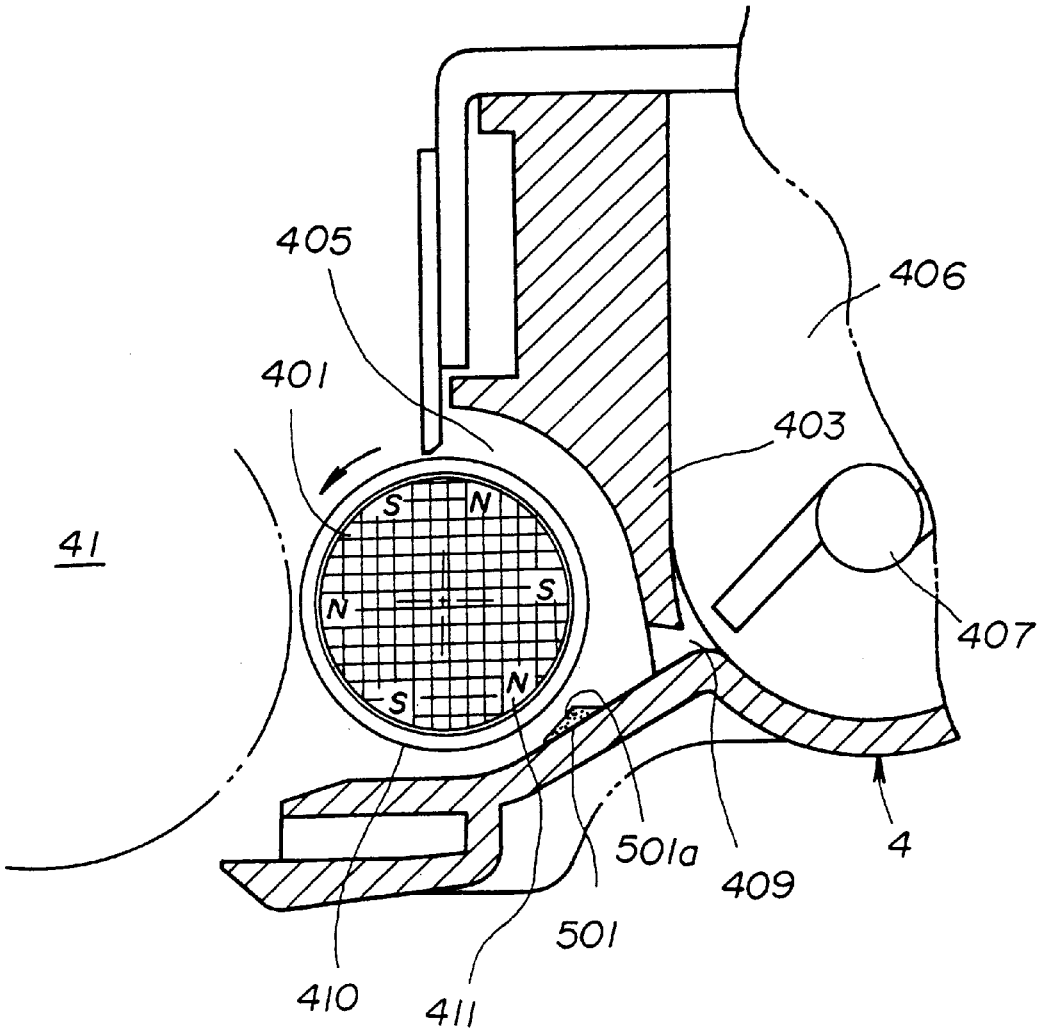
FIG. 5 is a cross sectional view showing the developing device provided with a developer leveling member.
Figure 6:
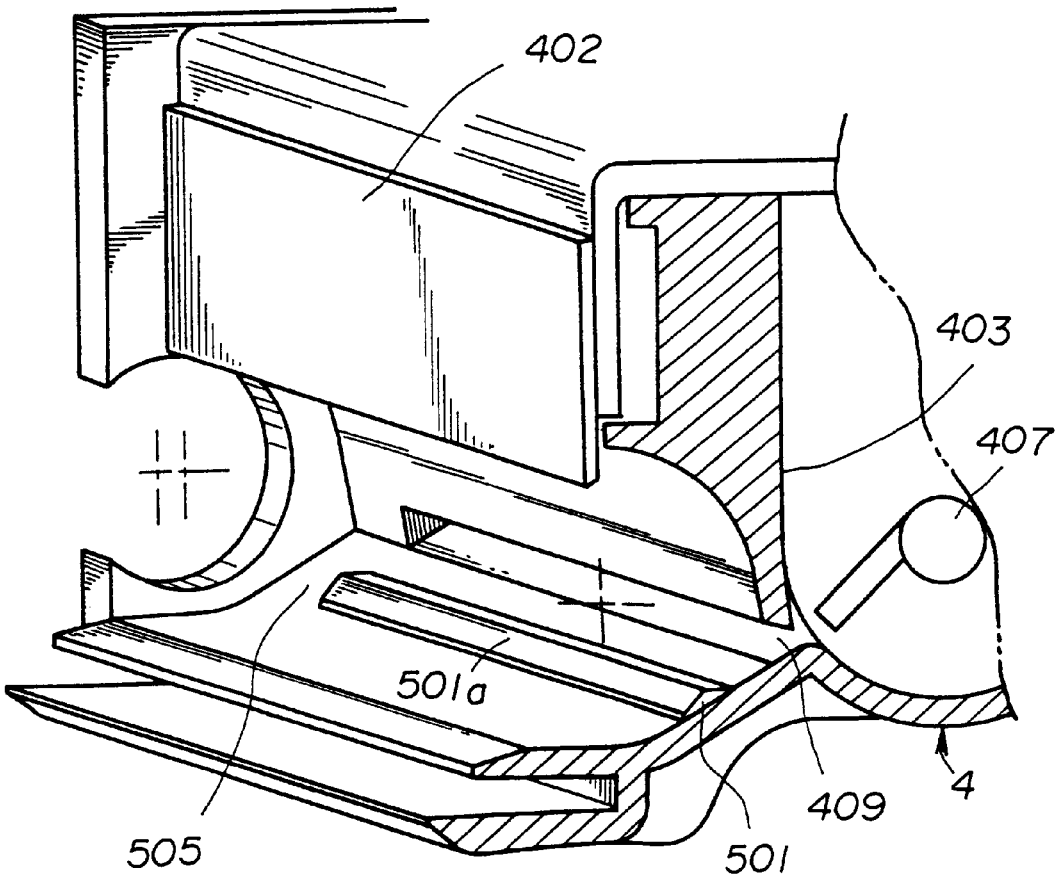
FIG. 6 is a perspective view showing the developing device with a partial cross section.

FIGS. 5 and 6 show another example of the developer leveling member.

Referring to FIGS. 5 and 6, a developer leveling member 501 is provided between the developing region and the toner supply opening 409 so that the bristles of the magnetic brush conveyed by the developing roller 401 are in contact with the developer leveling member 501. The developer leveling member 501 has a slope 501*a* facing the developing roller 401. A gap between the slope 501 of the developer leveling member 501 and the developing roller 401 gradually narrows in the rotational direction of the developing roller 401. Thus, the developer (the magnetic brush) conveyed in accordance with the rotation of the developing roller 401 can be smoothly leveled by the slope 501*a* of the developer leveling member 501.

Figure 7:
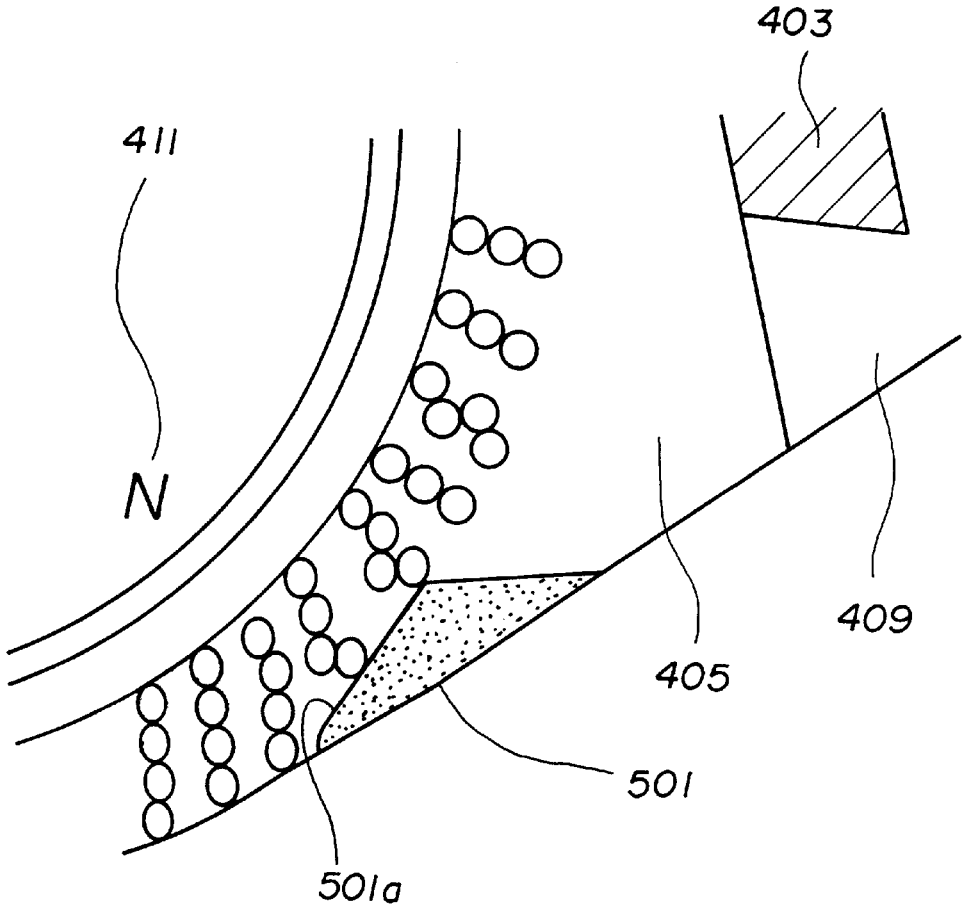
FIG. 7 is a diagram illustrating a function of the developer leveling member.

As shown in FIG. 7, since the gap between the slope 501*a* of the developer leveling member 501 and the developing roller 401 gradually narrows in the rotation direction of the developing roller 401, while the developing roller 401 is rotated, the magnetic brush which has passed though the developing area is gradually pressed against the slope 501*a* of the developer leveling member 501. Thus, the magnetic brush can be leveled without cutting the bristles of the magnetic brush, so that the carriers are hardly accumulated on the developing area side of the developer leveling member 501.

The developer leveling member 501 is provided so as to face a magnetic pole of the fixed magnetic pole body 411 via the sleeve 410. Thus, the magnetic brush is leveled by the developer leveling member 501 in a state where the bristles (formed of carriers) of the magnetic brush rise by means of magnetic force of the magnetic pole. Thus, the magnetic brush can be securely leveled.

The fixed magnetic pole 411 faces the developer leveling member 501. In a region in which the fixed magnetic pole 411 and the developer leveling member 501 faces each other, the magnetic brush stands. Thus, even if the gap between the developing roller 401 and the developer leveling member 501 is wide, since the magnetic brush is brought into contact with the developer leveling member 501 and the density of the developer is low, the developer is smoothly moved even if the bristles of the magnetic brush is brought into contact with the developer leveling member 501. Thus, stress in the developer passing through the gape between the developing roller 401 and the developer leveling member 501 is not increased.

According to experiments by the inventors of the present invention, in a case where a gap between the end of the doctor blade 402 and the developing roller 401 is 0.335 millimeters (mm) and a gap between the developing roller 401 and the partition member 403 in the carrier container 505 is 2 millimeters (mm), it is preferable that the minimum gap between the developing roller 401 and the developer leveling member 501 falls preferably within a range of 1.0–1.9 millimeters (mm). It is further preferable that the minimum gap falls within a range of 1.3–1.8 millimeters (mm).

When the gap between the surface of the developing roller 401 and the doctor blade 402 is varied, the minimum gap between the developing roller 401 and the developer leveling member 501 should be varied. The lower limit of the gap corresponds to value by which the developer overflows. The upper limit of the gap depends on the height of each of the bristles of the magnetic brush. Since when the strength of the fixed magnetic pole is varied, the height of each of the bristles is varied, the lower and upper limits of the gap should be decided based on experiments and/or simulations so as to fit conditions of the developing device.

Figure 8:
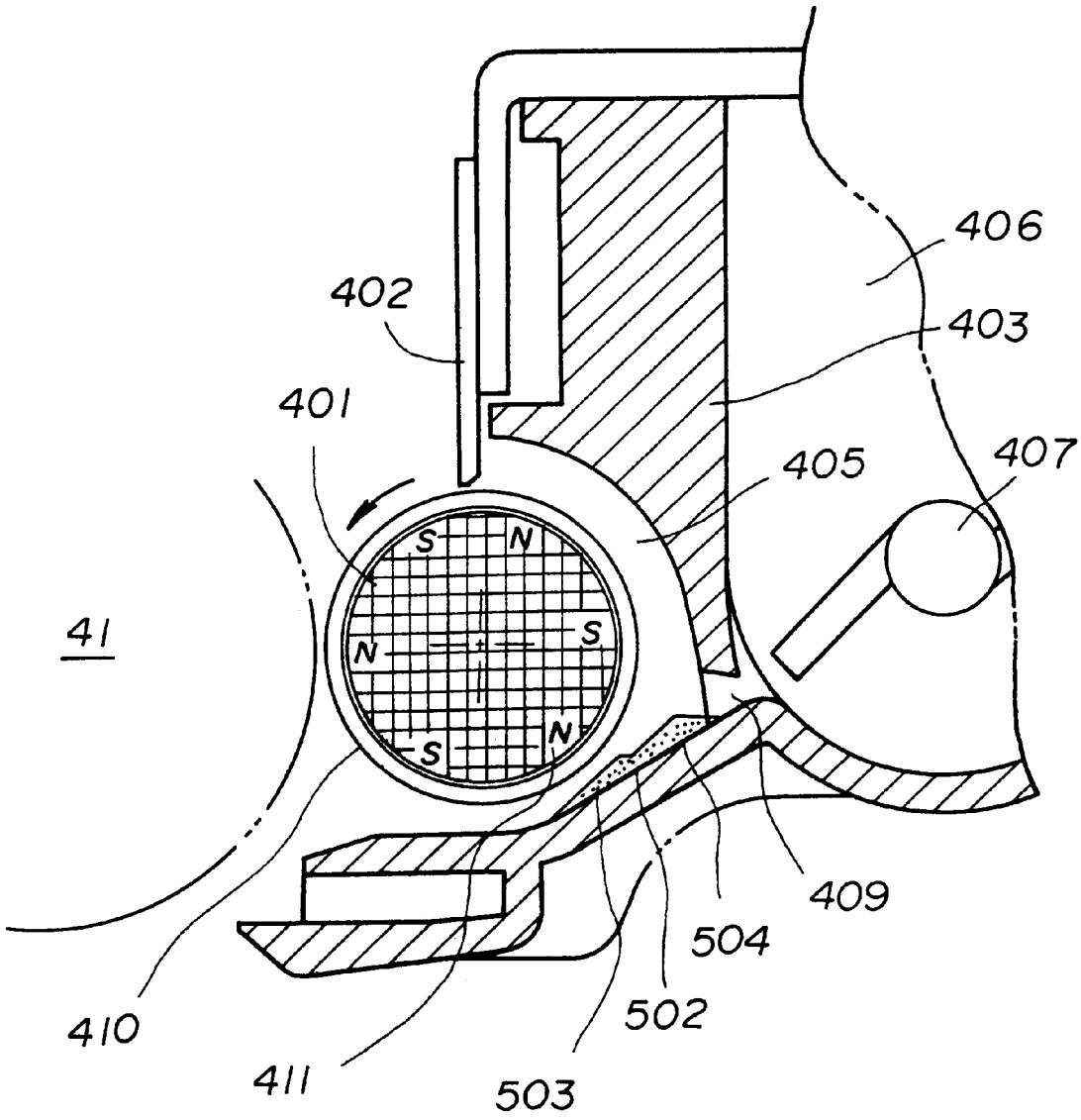
FIG. 8 is a cross sectional view showing the developing device having a developer control portion.

As shown in FIG. 8, a developer control member 502 may be provided in a region between the developing roller 401 and the toner supply opening 409. The developer control member 502 is formed of a developer leveling member 503 and a toner blocking member 504. The developer leveling member 503 levels the magnetic brush which has passed through the developing area as described above. The toner blocking member 504 prevents the toner from reaching the developer leveling member 503.

The magnetic brush formed on the developing roller 401 is gradually pressed against the developer leveling member 503 in accordance with the rotation of the developing roller 401 as described above. As a result, the magnetic brush is uniformly leveled.

The toner in the toner container 406 is supplied to the carrier container 405 via the toner supply opening 409 by the rotation of the agitator 407. In order to achieve miniaturization and cost reduction, the developing device 40 in the present embodiment has no mechanism, for controlling an amount of supplied toner, such as sensors and a control unit for controlling the rotation of the agitator 407. The developing device 40 is designed so that an amount of toner required for a print closely filled with toner on almost the whole surface of a recording paper (a non-segmented print) is supplied via the toner supply opening 409. Thus, in general cases of character prints, the toner is oversupplied to the carrier container 405. In a case where the developer leveling member 503 is provided between the toner supply opening 409 and the developing roller 401 in such a state, the pressure of the supplied toner is increased on the downstream side of the developer leveling member 503 in the rotation direction of the developing roller 401. As a result, the toner can not be stably supplied. In order to prevent the pressure of the supplied toner from being increased on the downstream side of the developer leveling member 503, the toner blocking member 504 is provided on the downstream side of the developer leveling member 503 in the rotation direction of the developing roller 401.

A surface of the toner blocking member 504 facing the toner supply opening 409 blocks the toner approaching the developer leveling member 503. Thus, the toner is prevented from reaching the developer leveling member 503, so that the pressure of the supplied toner on the downstream side of the developer leveling member 503 in the rotation direction of the developing roller 401 is not increased. Thus, the toner can be stably supplied to the magnetic brush formed on the developing roller 401.

The minimum gap between the toner blocking member 504 and the developing roller 401 is preferably set at substantially the same as the space in the carrier container 405 (about 2 millimeters (mm)).

The developer leveling member 50 shown in FIG. 4, the other embodiment of the developing member 501 shown in FIGS. 5 and 6, and the developer control member 502 formed of the developer leveling member 503 and the toner block member 504 as shown in FIGS. 8 may be formed by a composite manufacturing, such as a molding process, so as to be one with the housing 43 of the developing device 40. In this case, the developing device 40 can be easily formed at a low cost.

In the example as shown in FIG. 6, the developer leveling member 501 extends in the width direction of the developing device 40. If the developer leveling member 501 has the same width as the developing device 40, the toner is concentrated on the both sides of the developer leveling member 501. The toner in the toner container 406 is always supplied via the toner supply opening 409 by the agitator 407. Although a part of the toner supplied via the toner supply opening 409 is fed to the magnetic brush, a part of remaining toner is pressed against the developer leveling member 501 and another part of the remaining toner is forwarded to the carrier container 405. Further another part of the remaining toner may be accumulated and concentrated on the sides of the developer leveling member 501. When the toner is concentrated on the sides of the developer leveling member 501, the toner densities in the toner concentrated regions are increased. Thus, if the toner densities are increased in such regions, the toner is adhered to areas, facing the regions, of the photosensitive drum 41 in the developing area. As a result, lines are formed on both side portions of the recording paper on which a print is made.

To prevent such a formation of lines, spaces 505 are formed at both ends of the developer leveling member 501 as shown in FIG. 6. Due to the spaces 505, the toner pressure is loosened. Thus, the pressure of the developer on the sides of the developer leveling member 501 is hardly increased, so that the toner density is also hardly increased. As a result, the lines are prevented from being formed on the side portions of the recording paper on which the print is made.

The spaces 505 may correspond to areas outside an area on which images can be formed. The width of the developing device 40 is greater than the width of the recording paper having the maximum size in which the print can be made by the printer. Thus, the toner adhered to side portions of the magnetic brush corresponding to the areas outside the area on which images can be formed is not used for the development. However, even if the toner is further supplied to the side portions of the magnetic brush, the toner pressure is loosened by the spaces 505, so that the toner adhered to the side portions of the magnetic brush can be prevented from affecting the prints.

Figure 9:
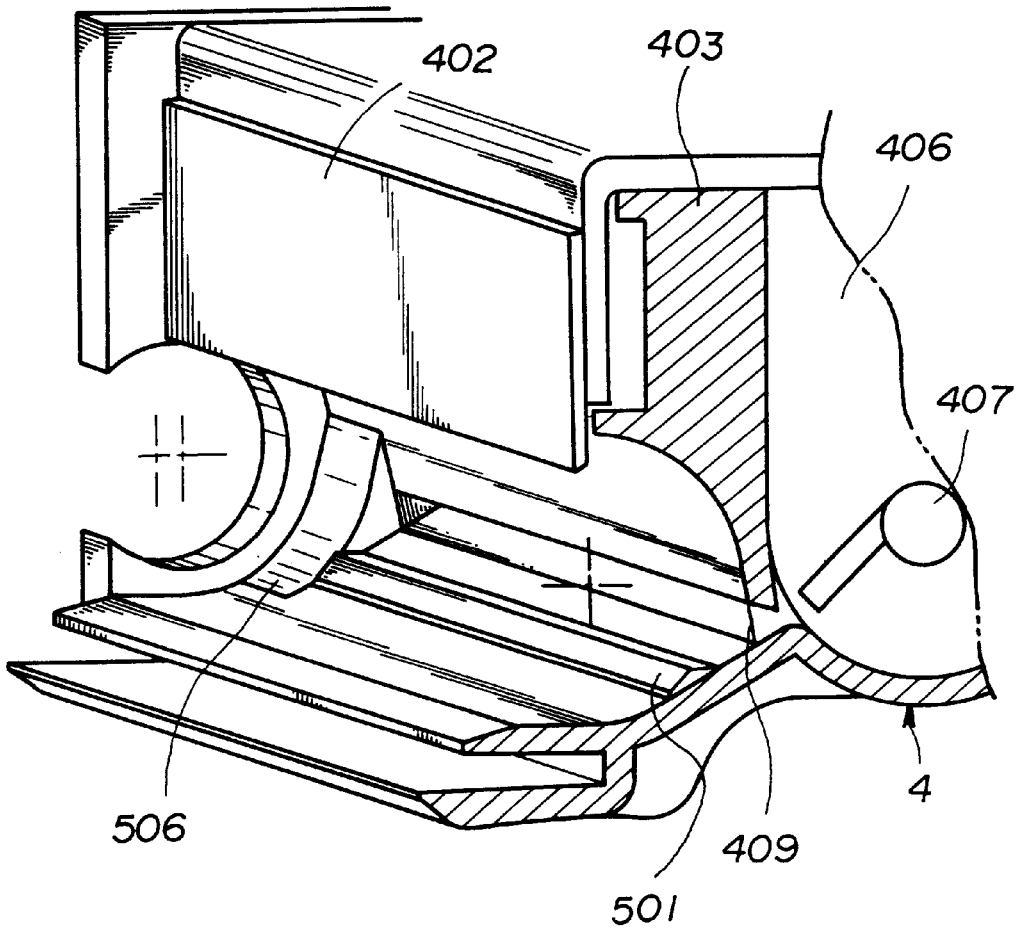
FIG. 9 is a perspective view showing the developing device having a block to preventing developer from entering side spaces of the developer leveling member.

In order to decrease the pressure on the sides of the developer leveling member 501, blocks 506 may be provided on both sides of the developer leveling member 501 as shown in FIG. 9. The blocks 506 prevent the toner from entering the sides of the developer leveling member 501. Due to the blocks 506, the toner is prevented from being accumulated on the sides of the developer leveling member 501. Even if the toner is accumulated on the sides of the developer leveling member 501, the toner is used for prints. Thus, the toner pressure is decreased, so that the lines are hardly formed in the side portions of the recording paper on which the print is made.

The present invention is not limited to the aforementioned embodiments, and other variations and modifications may be made without departing from the scope of the claimed invention.

The present invention is based on Japanese priority application No. 10-106336 filed on Apr. 16, 1998, the entire contents of which are hereby incorporated by reference.

What is claimed is:

1. A developing device for developing a latent image formed on a latent image holding body, comprising:

a rotatably supported developing roller which conveys, with rotation of said developing roller, developer adhered thereto to a developing area in which the latent image on the latent image holding body is developed, the developer including toner and carriers;

a limit member, provided so as to face said developing roller which limits a height of a layer of the developer on the developing roller;

a toner container which stores the toner;

a toner supply mechanism which supplies the toner in said toner container to said developing roller via a toner supply opening;

a partition member which forms a space between said partition member and said developing roller, the toner supplied from the toner container being moved in said space with rotation of said developing roller; and a developer leveling member which levels the developer that is formed on said developing roller and has passed through the developing area, wherein the developer leveling member is provided at a downstream position of the developing area in a rotation direction of the developing roller and on an upstream side of the toner supply opening in the rotation direction of the developing roller.

2. The developing device as claimed in claim 1, wherein said developing roller includes a fixed magnetic pole body on which a plurality of magnetic poles are arranged at intervals and a sleeve rotated around said fixed magnetic body, and wherein said developer leveling member is provided so as to face a magnetic pole of said fixed magnetic pole body via said sleeve.

3. The developing device as claimed in claim 1, wherein said developer leveling member has a slope facing said developing roller, a gap between said slope and said developing roller gradually narrowing in the rotation direction of said developing roller.

4. The developing device as claimed in claim 1, wherein a gap between said developer leveling member and said developing roller is greater than a gap between said limit member and said developing roller.

5. The developing device as claimed in claim 1 further comprising:

a toner blocking member, provided on a downstream side of said developer leveling member in the rotation direction of said developing roller, blocking the toner, which is supplied from said toner container via the opening, approaching said developer leveling member.

6. The developing device as claimed in claim 5, wherein a gap between said toner blocking member and said developing roller is substantially the same as a height of the space formed between said partition member and said developing roller.

7. The developing device as claimed in claim 5, wherein said developer leveling member and said toner blocking member are formed so as to be one with a housing of said developing device.

8. The developing device as claimed in claim 1, wherein said developer leveling member extends in a width direction of said developing roller, and spaces are formed on both sides of said developer leveling member.

9. The developing device as claimed in claim 1, wherein said developer leveling member extends in a width direction of said developing roller, and blocks are provided on both sides of said developer leveling member.

10. The developing device as claimed in claim 1, wherein said developer leveling member is formed so as to be one with a housing of said developing device.

* * * * *